US005845692A

United States Patent [19]

Kellem et al.

[11] Patent Number: 5,845,692

[45] Date of Patent: Dec. 8, 1998

[54] RAPID ACCESS PORTAL

[75] Inventors: Carl W. Kellem, Danbury, Conn.; Donald Parks, Boynton Beach, Fla.; George Riehm, New Fairfield, Conn.

[73] Assignee: Rapor, Inc., Danbury, Conn.

[21] Appl. No.: 746,935

[22] Filed: Nov. 18, 1996

[51] Int. Cl.[6] ..... E06B 3/48

[52] U.S. Cl. ..... 160/118; 160/206; 160/187; 160/1; 49/68

[58] Field of Search ..... 49/49, 68, 93, 49/95, 104, 109, 113, 116, 117, 118; 160/113, 114, 116, 199, 206, 180, 118–187

[56] References Cited

U.S. PATENT DOCUMENTS

| | | | |
|---|---|---|---|
| 1,184,725 | 5/1916 | Dawes | 49/68 |
| 3,380,191 | 4/1968 | Neeff et al. | 49/49 |
| 3,742,647 | 7/1973 | Tomita | 49/68 X |
| 3,967,411 | 7/1976 | Ulmann | 49/68 |
| 4,136,641 | 1/1979 | Hoffmann | 119/155 |
| 4,261,297 | 4/1981 | Van Maarion et al. | 119/155 |
| 4,534,395 | 8/1985 | Carroll | 160/199 |
| 4,718,205 | 1/1988 | Taylor | 52/79.8 |
| 5,183,008 | 2/1993 | Carrano | 119/155 |
| 5,212,909 | 5/1993 | Morin | 49/49 |
| 5,335,710 | 8/1994 | Belanger | 160/199 X |

*Primary Examiner*—Jerry Redman
*Attorney, Agent, or Firm*—DeLio & Peterson, LLC

[57] ABSTRACT

A rapid access door system is provided wherein authorized individuals may pass through the door system and wherein unauthorized individuals are blocked from entering a secured area past the doors and are automatically rerouted to an unsecured area for further processing without blocking the door system and impeding the flow of other individuals entering the door system. The door system uses modular units employing sensing means and a specially configured door which door automatically provides the rerouting of persons in the system. The sensing means determines, among others, the number of persons in the system, whether the door is opened or closed, whether a person has exited the system to particular areas, alerting speakers and signage, with the above information being used in conjunction with the door system to provide a highly efficient and effective rapid access portal system.

35 Claims, 9 Drawing Sheets

RAPID ACCESS PORTAL

BACKGROUND OF THE INVENTION

1. Field of the Invention

The present invention relates generally to a portal (door) system having a door or gate device which prohibits unauthorized entry to an area downstream of the door and, in particular, to a rapid access door system utilizing module units comprising a specially configured door and sensors and a logic control system to position the door in a desired opened or closed position and wherein the door in its open position permits access to a secure area downstream of the door and in its closed position prevents access to the secured area and automatically reroutes a party to an unsecured area through a doorway formed when the door is in a closed position.

2. Description of Related Art

There is a need for new door systems to control access to areas depending on authorization or the payment of a fare or fee and in particular to a door system which can process many people rapidly and effectively. The door control system should permit unimpeded rapid access for fare paying individuals at an entrance like to a subway or for authorized persons to a secured area such as in an airport while rejecting unauthorized individuals and without impeding traffic flow by rapidly rerouting them automatically to unsecured areas where they can be properly processed.

Current door control systems that provide an entrance way or access to secure areas have the undesirable problems of tailgating, slow processing of individuals and the need for a dedicated staff to monitor individuals passing through the door system. Tailgating is a major problem when using a traditional door as a security door since once the door is unlocked or opened there is no control over the number of persons that can enter through the unlocked door. Positive access control doors that use turnstiles, revolving doors or such other man "traps" can control this problem, however, these devices require additional time for processing each individual and special provisions for wheelchairs and other such walking aids people may use.

Normally open doors such as "optical turnstiles" and metal detectors can expedite movement through the door if the individuals using the door are authorized and follow the predefined procedures correctly. Since there are many individuals who are not authorized, adequate staff is required to stop these individuals and reprocess them. The staff for open door systems must maintain continual diligence, persistence and sharp attention which is a most difficult requirement for the staff and a substantial labor cost for management. The typical metal detector at an airport is an example of the nuisance and inconvenience caused when traveling.

Additionally, both the positive access control doors and the normally open doors usually require unauthorized persons to reverse their direction at the door causing inconvenience for those that may be behind them and a slowing down of the passage process.

U.S. Pat. No. 5,212,909 to Morin discloses a passage having controlled access to a secured area provided by a closure device, i.e., door, which is hinged about a vertical axis. The door may be disposed to open and close in two different directions in the aisle allowing passage in two directions through the door. The patent does not address the problem of the rapid passage of persons through the door system and unauthorized persons would be stopped by the closed door and block the passageway causing a disruption of flow through the passage.

Bearing in mind the problems and deficiencies of the prior art, it is therefore an object of the present invention to provide a door system having a door or other closure device which system provides rapid processing of authorized individuals for entry through the door to a secure or other such area and automatic rerouting to an unsecured area for unauthorized individuals without significant interruption to the flow of people entering the door system.

It is a further object of the invention to provide a door system apparatus to provide rapid processing of individuals for passage through the door to a secure area for authorized individuals and to an unsecured area for unauthorized individuals.

It is another object of the invention to provide a modular door system including sensors and a control system which door system enables the efficient automatic rapid processing of individuals entering the system and avoids the problems of unauthorized access by tailgating and the like.

An additional object in the invention is to provide a door containing module comprising a door unit which automatically reroutes to an unsecured area unauthorized persons attempting to enter through the door.

Other objects and advantages of the present invention will in part be obvious and will in part be apparent from the specification.

SUMMARY OF THE INVENTION

The above and other objects and advantages, which will be apparent to those skilled in the art, are achieved in the present invention which is directed to, in a first aspect, to a portal (door) system comprising:

an entrance having authorization means for authorizing a person to pass therethrough;

an aisle extending from the entrance to a bi-fold door and past the bi-fold door to a secure area;

a doorway situated before the bi-fold door on one side of the aisle for exiting the aisle to an unsecure area;

the bi-fold door which is pivotable on vertical axes and is fixedly secured at one pivot axis to the aisle;

means for moving the door based on the authorization means on a third pivot axis along a line parallel to the aisle; and wherein when the door is closed, the door blocks the aisle to the secure area and the doorway is open to the unsecure area and when the door is open, the aisle is open to the secure area and the door blocks the doorway to the unsecure area.

In a second aspect a door system is provided comprising:

a door or other closure device;

an entrance having identifying means or authorization means for identifying or authorizing a person passing therethrough;

a first aisle extending from the entrance through the door to a first area, the first aisle being formed by, in sequence, a left entrance module and an opposed right entrance module, a left door and an opposed right door each extending in its closed position across about half the width of the first aisle wherein the doors in their open position allow passage from the entrance to the first area with the left door forming a left door wall and the right door forming an opposed right door wall, and, a left door containing module forming a left door module wall and an opposed right door containing module forming a right door module wall;

a left doorway intersecting the first aisle between the downstream end of the left entrance module and the start of the left door containing module; and a right doorway intersecting the first aisle between the downstream end of the right entrance module and the start of the right door containing module;

the left door containing module comprising a left door having an open position which provides communication of the first aisle with the first area and having a closed position which blocks about half the width of the first aisle and provides communication of the first aisle with the left doorway;

the right door containing module comprising a right door having an open position which provides communication of the first aisle with the first area and having a closed position which blocks about half the width of the first aisle and provides communication of the first aisle with the right doorway;

the left door having a first left vertically pivotal member hinged at both ends by a first left hinge fixedly secured to the left door containing module and a second left hinge, a second left vertically pivotal member hinged at one end by the second left hinge and at the other end by a third left hinge and a third left vertically pivotal member hinged at one end by the third left hinge and at the other end being attached to a left carriage which third left member moves rectilinearly with the left carriage in and out of the module along the longitudinal axis of the left door containing module when the door is opened or closed and has an extended and a retracted position;

the right door having a first right vertically pivotal member hinged at both ends by a first right hinge fixedly secured to the right door containing module and a second right hinge, a second right vertically pivotal member hinged at one end by the second right hinge and at the other end by a third right hinge and a third right vertically pivotal member hinged at one end by the third right hinge and at the other end being attached to a right carriage which third right member moves rectilinearly with the right carriage in and out of the module along the longitudinal axis of the right door containing module when the door is opened or closed and has an extended and a retracted position;

wherein when the left door and right door are in their closed positions by the left carriage and right carriage being retracted respectively in the left door containing module and right door containing module, communication of the first aisle with the first area is blocked and both the left doorway and right doorway are open; and wherein when the left door and right door are both in their open position by each carriage being extended respectively toward the left entrance module and right entrance module, communication of the first aisle with the first area is open and both the left doorway and right doorway are blocked.

In another aspect of the invention, a rapid access portal (door) apparatus is provided comprising:

an entrance having authorization means for authorizing a person to pass therethrough;

an aisle extending from the entrance to a bi-fold door and past the bi-fold door to a secure area;

a doorway situated before the bi-fold door on one side of the aisle for exiting the aisle to an unsecure area;

the bi-fold door which is pivotable on vertical axes and is fixedly secured at one pivot axis to the aisle;

means for moving the door based on the authorization means on a third pivot axis along a line parallel to the aisle; and wherein when the door is closed, the door blocks the aisle to the secure area and the doorway is open to the unsecure area and when the door is open, the aisle is open to the secure area and the door blocks the doorway to the unsecure area;

sensing means for determining information about persons entering the apparatus or the position of the door;

moving means for opening and closing the door;

control means for opening and closing the door in response to the sensing means.

In a further aspect of the invention a door apparatus is provided comprising:

a door or other closure device;

an entrance having identifying means or authorization means for identifying or authorizing a person passing therethrough;

a first aisle extending from the entrance through the door to a first area, the first aisle being formed by, in sequence, a left entrance module and an opposed right entrance module, a left door and an opposed right door each extending in its closed position across about half the width of the first aisle wherein the doors in their open position allow passage from the entrance to the first area with the left door forming a left door wall and the right door forming an opposed right door wall, and, a left door containing module forming a left door module wall and an opposed right door containing module forming a right door module wall;

a left doorway intersecting the first aisle between the downstream end of the left entrance module and the start of the left door containing module; and a right doorway intersecting the first aisle between the downstream end of the right entrance module and the start of the right door containing module;

the left door containing module comprising a left door having an open position which provides communication of the first aisle with the first area and having a closed position which blocks about half the width of the first aisle and provides communication of the first aisle with the left doorway;

the right door containing module comprising a right door having an open position which provides communication of the first aisle with the first area and having a closed position which blocks about half the width of the first aisle and provides communication of the first aisle with the right doorway;

the left door having a first left vertically pivotal member hinged at both ends by a first left hinge fixedly secured to the left door containing module and a second left hinge, a second left vertically pivotal member hinged at one end by the second left hinge and at the other end by a third left hinge and a third left vertically pivotal member hinged at one end by the third left hinge and at the other end being attached to a left carriage which third left member moves linearly with the left carriage in and out of the module along the longitudinal axis of the left door containing module when the door is opened or closed and has an extended and a retracted position;

the right door having a first right vertically pivotal member hinged at both ends by a first right hinge fixedly secured to the right door containing module and a second right hinge, a second right vertically pivotal member hinged at one end by the second right hinge and at the other end by a third right hinge and a third right vertically pivotal member hinged at one end by the third right hinge and at the other end being attached to a right carriage which third right member moves linearly with the right carriage in and out of the module along the longitudinal axis of the right door containing module when the door is opened or closed and has an extended and a retracted position;

wherein when the left door and right door are in their closed positions by the left carriage and right carriage being retracted in the left door containing module and right door containing module respectively, communication of the first aisle with the first area is blocked and both the left doorway and right doorway are open; and wherein when the left door and right door are both in their open position by each carriage being extended toward the left entrance module and right entrance module respectively, communication of the first aisle with the first area is open and both the left doorway and right doorway are blocked;

sensing means for determining authorization of a person entering the system and preferably to determine if the proper number of persons are in the system, if the system is clear (no persons in the system), if the door is opened or closed, if the person entering the system has exited the system and visual and audio means to alert and/or instruct the person in the system and/or waiting to enter the system and/or security personnel.

control (motor) means for opening and closing the doors in response to the sensing means.

In a further aspect of the present invention a control system is provided to be used with the door system and door apparatus of the invention to allow the rapid processing of individuals through the door system without the need for excessive personnel and which system is cost effective. The control system comprises the following features which are preferably used together or may be used singly or in any combination depending on the amount of control of the system desired:

sensing authorization means to determine if a person is authorized to enter the system;

sensing people flow means to determine how many persons are in the system;

sensing door means to determine if the door is fully closed or fully opened;

sensing door position indicator means preferably motor motion door position indicator means to determine the position of the door while the door is moving which position is used to control the motor speed to close the door rapidly initially and slowly as the door approaches the closed position and to open the door rapidly initially and slowly as the door approaches the opened position;

sensing door blockage means to determine if the door is being obstructed from closing or opening, which sensing means will be used to control stopping the motor means, reversing the motor to open or close the door slightly, activate alarms, and attempt to close or open the door again after a predetermined time. This procedure is repeated until the doors are fully closed or opened;

sensing doorway exit means to determine if a person exits a doorway of the system;

sensing aisle exit means to determine if a person exits an aisle of the system;

door locking means, preferably electromagnetic, to prevent forcible movement of the door from a closed or opened position;

manual door control means to override the system using a local or emote switch to allow opening and closing the door;

audio and visual alerting means to instruct and/or alert a person in the system or security personnel;

computer means to receive data from the above sensing means and using software to determine control outputs to transmit control signals to the modules based on the received data, logic and time, e.g., timing means to determine the length of time a person is in the system and whether or not this length of time is unreasonable and if an alarm should be generated.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

Figure 1:
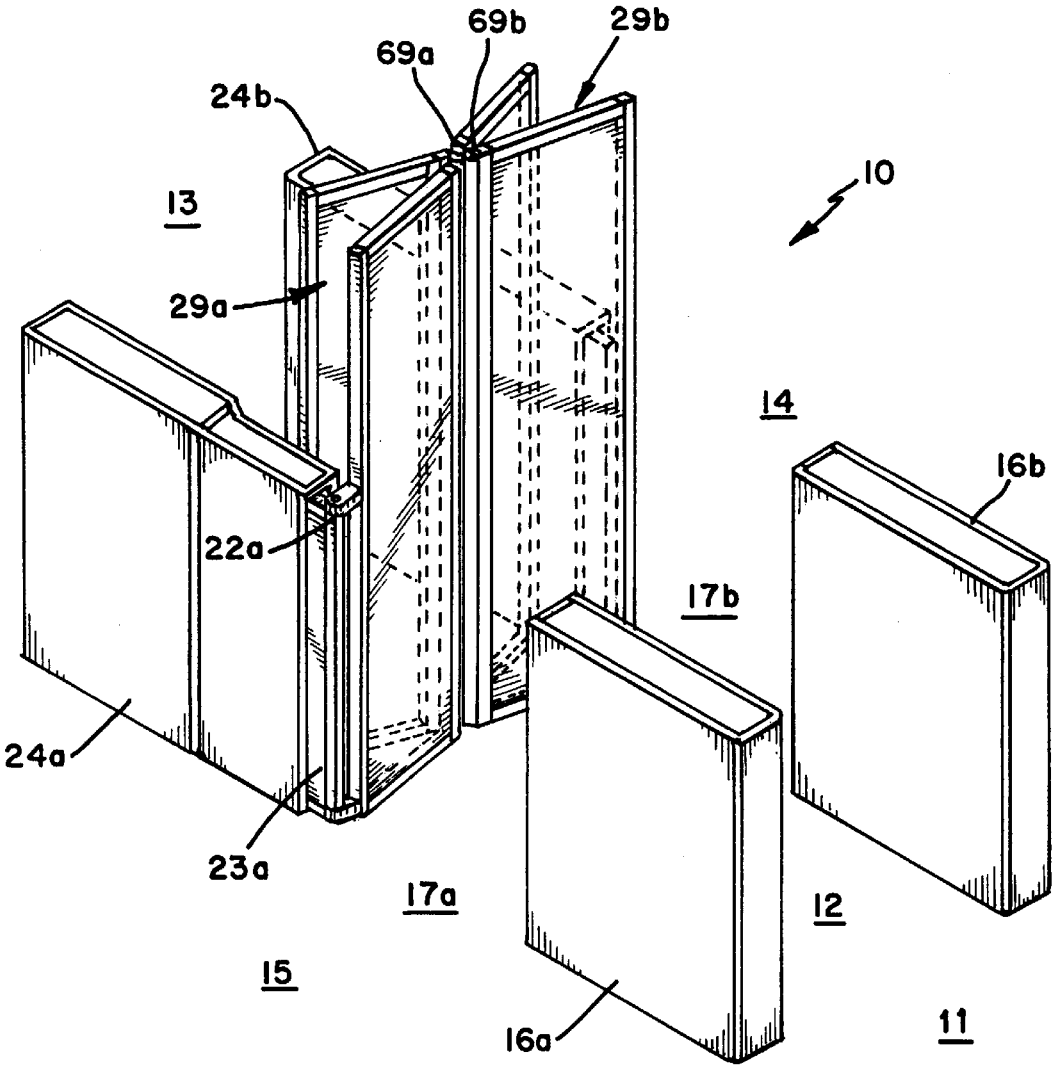
FIG. 1 is a perspective view of the rapid access portal system of the invention.

In describing the preferred embodiments of the present invention, reference will be made herein to FIGS. 1–7 of the drawings in which like numerals refer to like features of the invention. Features of the invention are not necessarily shown to scale in the drawings.

Referring to FIG. 1, a perspective view of a typical rapid access door system showing the doors in a closed position is shown generally as 10. The system has a first entrance 11, a first aisle 12 which first aisle extends for unimpeded passage through the doors (open) to first area 13. The first aisle 12 is formed, in sequence, by a left entrance module 16*a* and an opposed right entrance module 16*b*, in their open positions by a left door 29*a* and a right door 29*b* and a left door containing module 24*a* and an opposed right door containing module 24*b*. The doors 29*a* and 29*b* are shown in their closed position which blocks passageway through the first aisle 12 to the first area 13. The doors 29*a* and 29*b* in their open position as shown below in FIG. 2 in phantom block left doorway 17*a* and right doorway 17*b* preventing access to third area 15 and second area 14, respectively. The doors in their closed position prevent access to first area 13. Sensing door blockage means 69*a* and 69*b* are employed to determine if the door is being obstructed from closing or opening and generally comprises a sensor in a rubberized sleeve running the height of each door. If an obstruction is placed in the door the sensor is activated and the system will attempt to reclose the door as described below Referring to FIG. 2, the doors 29*a* and 29*b* are shown as oppositely disposed and abutting in about the center of first aisle 12 and the following description will be for left door 29*a* only with it being understood that the same structure is shown for door 29*b*. While electromagnetic locks are provided to lock the door in their open position as described below, a similar locking control may be used to lock the doors in their closed position. Left door 29*a* comprises a left first hinge 18*a* fixedly connected to left door containing module 24*a* and to one end of left door first panel 19*a*. Left door first panel 19*a* is hinged at its other end to left second hinge 20*a*. Left second hinge 20*a* is connected to one end of left door second panel 21*a* and at the other end to left third hinge 22*a*. Also connected to left third hinge 22*a* is left door third panel 23*a*. Left door third panel 23*a* is shown in the retracted position into left panel module 24*a* but may also be extended to its open position blocking left doorway 17*a* as shown in phantom. As shown in the phantom position, left door 29*a* in the extended position provides a barrier to left doorway 17*a* and third area 15 and door 29*b* will likewise block right doorway 17*b* and access to second area 14. An automatic controlled locking mechanism locking hinges 20*a* and 20*b* can be used to lock the door when closed.

The doors 29*a* and 29*b* are generally classified as bi-fold doors which may each be defined as comprising a first door 19*a* and second door 21*a*. The first door and second door are hinged together (hinge 20*a*) to form a vertical pivotal central axis. The first door is hinged at its other end (hinge 18*a*) to form a vertical pivotal first axis and which hinge is fixedly secured to a structure such as in this case to the aisle. The second door has rectilinear guide means at its other end (shown as hinge 22*a*) forming a vertical pivotal second axis which guide means is guided along a line parallel to the aisle. When the second axis is extended along the line away from the first axis, the first door and second door in their fully extended position are in the same plane and form a door blocking the doorway. When the second axis is moved toward the first axis, the first door and second door in their fully retracted position are opposed in the aisle and block the aisle. The use of a bi-fold door is an important feature of the invention since it promotes rapid processing of persons using the system by not forming a wide arc in the aisle.

If an authorized person enters first aisle 12, left door 29*a* and right door 29*b* will be opened and the person will have access through first aisle 12 to secured first area 13. If the person is not authorized, left door 29*a* and right door 29*b* will remain closed and extend across first aisle 12 closing access to first area 13. A left doorway barrier 27 is shown which when left door 29*a* is in its closed position will prevent access to third area 15. Door 29*b* will also be in its closed position and the person would exit through right doorway 17*b* to second area 14. There is no need for the unauthorized person to stop at closed doors 29*a* and 29*b* and reverse direction and walk back first aisle 12 out first entrance 11. This would impede the flow of individuals trying to gain access to first area 13 and would therefore inhibit the flow of individuals into the door system and down first aisle 12. Unauthorized individuals would simply proceed through the open right doorway 17*b* to second area 14 and the next person entering first entrance 11 would proceed down first aisle 12 either to first area 13, if authorized, or through open right doorway 17*b* to second area 14 if unauthorized.

Figure 2:
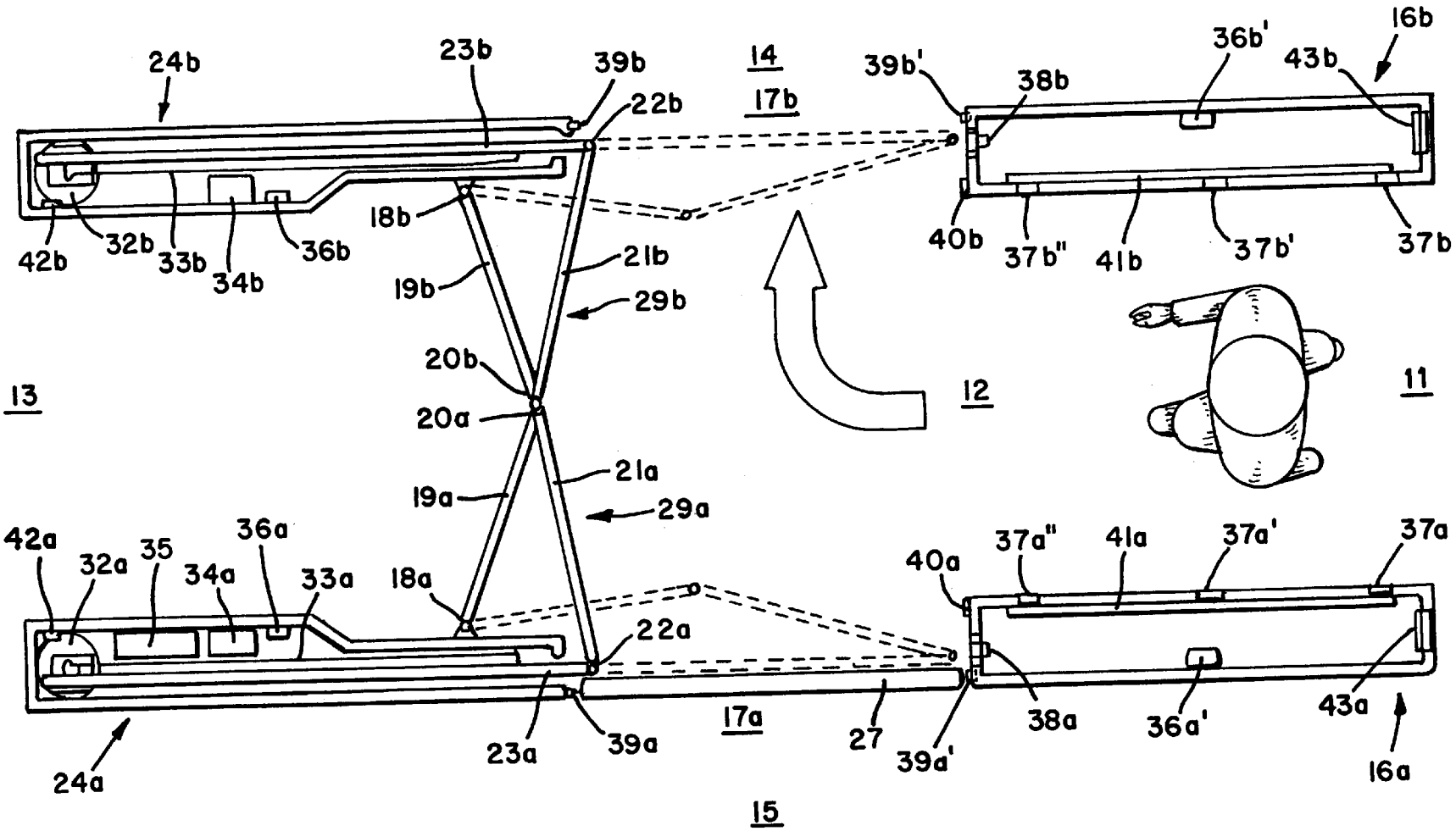
FIG. 2 is a schematic top view diagram of a typical door system according to the invention showing control features of the invention.

Referring again to FIG. 2, the use of sensors, speakers and signs to instruct persons entering the system is described. As shown in FIG. 2, first aisle 12 is formed by left entrance module 16*a* and opposing right entrance module 16*b*. Left door 29*a* and right door 29*b* are shown in the closed position preventing access to first area 13. Left door control module 24*a* and opposed right door control module 24*b* are shown forming the continuation of first aisle 12. The doors as discussed hereinabove are shown having members 19*a*, 19*b*, 21*a*, 21*b* and 23*a* and 23*b* which members are hinged together by hinges 18*a*, 18*b*, 20*a*, 20*b*, 22*a* and 22*b* respectively. The door system comprises a left drive motor 32*a* and right drive motor 32*b* positioned in their respective door control modules. When the motors are actuated, left drive belt 33*a* and right drive belt 33*b* are put in motion and move left door third panel 23*a* and right door third panel 23*b* in this case to an extended position opening aisle 12 and permitting access to first area 13. Left motor control 34*a* and right motor control 34*b*, central processing unit 35 and left multiplexer 36*a* and right multiplexer 36*b* are shown positioned within the respective left door control module 24*a* and right door control module 24*b*.

Left entrance module 16*a* and right entrance module 16*b* contain left entrance people flow sensors 37*a*, 37*a*' and 37*a*" and opposed right entrance people flow sensors 37*b*, 37*b*' and 37*b*" respectively. Additional sensors may be positioned vertically on the modules. Typically these will be positioned vertically at each sensor location for a total of nine sensors on each module shown in the figure. These sensors enable the system to determine the presence of a person (or more than one person) in the system and to prevent a person from crawling under the sensors. Also contained within left entrance module 16*a* and right entrance module 16*b* is left multiplexer 36*a*' and right multiplexer 36*b*' respectively. Multiplexers 36*a* and 36*a*', 36*b* and 36*b*' are connected to computer 35 to provide communication from all sensors and to provide all commands to sensors, locks and indicators. Left door electromagnetic lock 38*a* and right door electromagnetic lock 38*b* are positioned so that when doors 29*a* and 29*b* are in an open position hinge 22*a* would contact lock 38*a* and hinge 22*b* would contact lock 38*b* thereby creating an electromagnetic lock. The lock is controlled by the system and can be unlocked when the doors are to be in an open position. Hinges 20*a* and 20*b* may likewise have an electromagnetic or other lock activated when the doors are in their closed positions and the hinges abut. Left speaker 40*a* and right speaker 40*b* are shown disposed in their respective wall modules and are used to announce messages, instructions to the individual in the system or waiting to enter the system or to provide an alert signal to security personnel.

Figure 4:
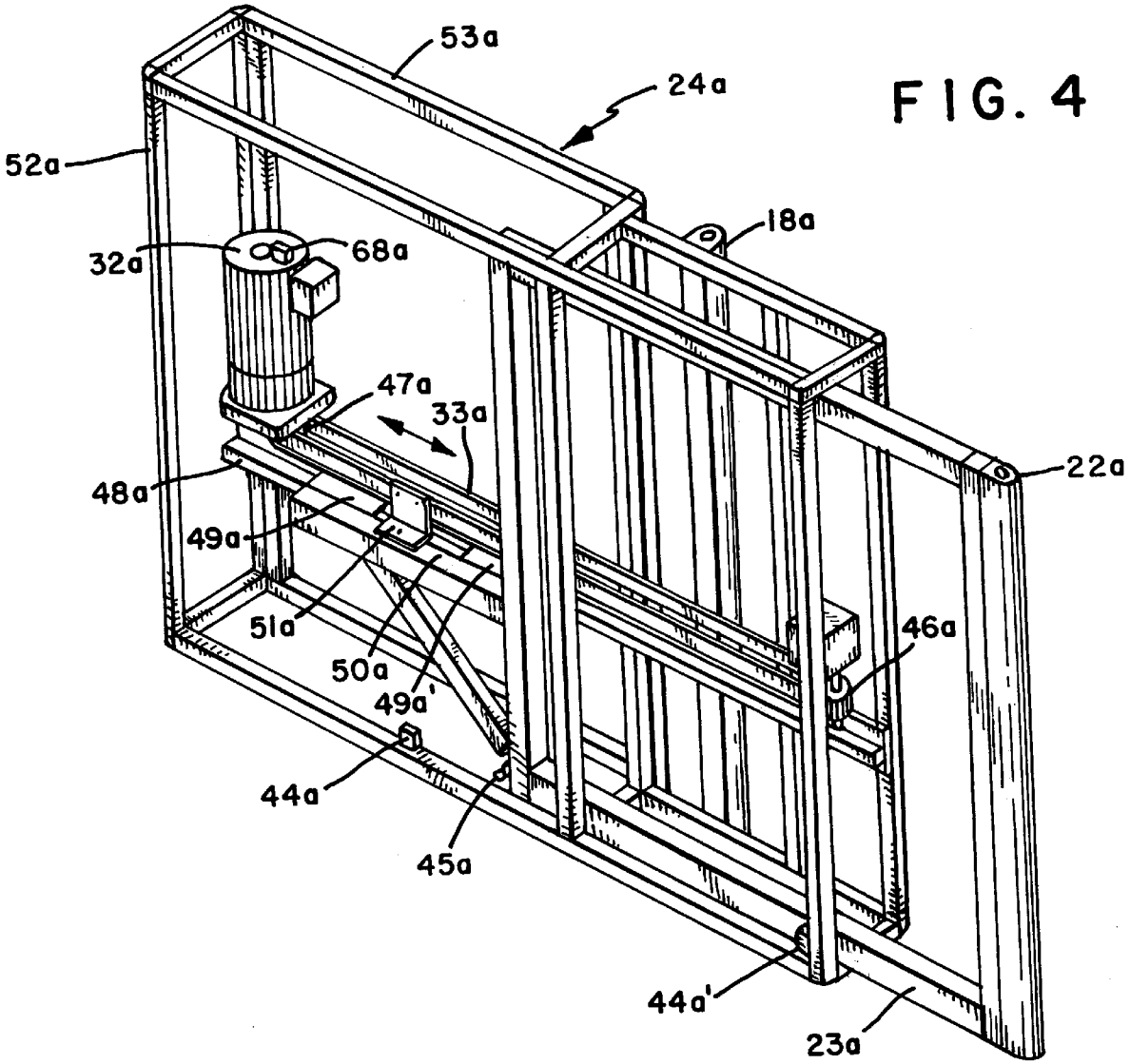
FIG. 4 is a skeleton perspective view of the left door containing module of the invention.

LED displays are shown as left entrance module LED display 41*a* and right entrance module LED display 41*b* and are used to provide visual messages to people in aisle 12 or at entrance 11. The displays may also be positioned across the width of aisle 12 at the entrance 11, the end of modules 16*a* and 16*b* or above the doors to provide a visual message such as "Wait", Proceed", etc. Doorway exit sensors 39*a*, 39*a*', 39*b* and 39*b*' are used to indicate movement through doorways 17*a* and 17*b*. Likewise, left exit aisle sensor 42*a* and right exit aisle sensor 42*b* are used to detect movement through aisle 12 into first area 13. Auxiliary authorization sensors shown as 43*a* and 43*b* positioned at the first entrance 11 of aisle 12 may be sensors such as card readers, fare boxes, etc. which are used by individuals passing through the entrance to indicate if the person is authorized. All sensor information would be inputted to the CPU unit 35 to control the portal system. Not shown are sensing door means, sensing door position indicator means, (preferably motor motion means) which are shown in FIG. 4. Manual door control means 54*a* e.g., a switch, (shown in FIG. 7A) may be positioned anywhere in the system such as in left door control module 24*a*.

Figure 3:
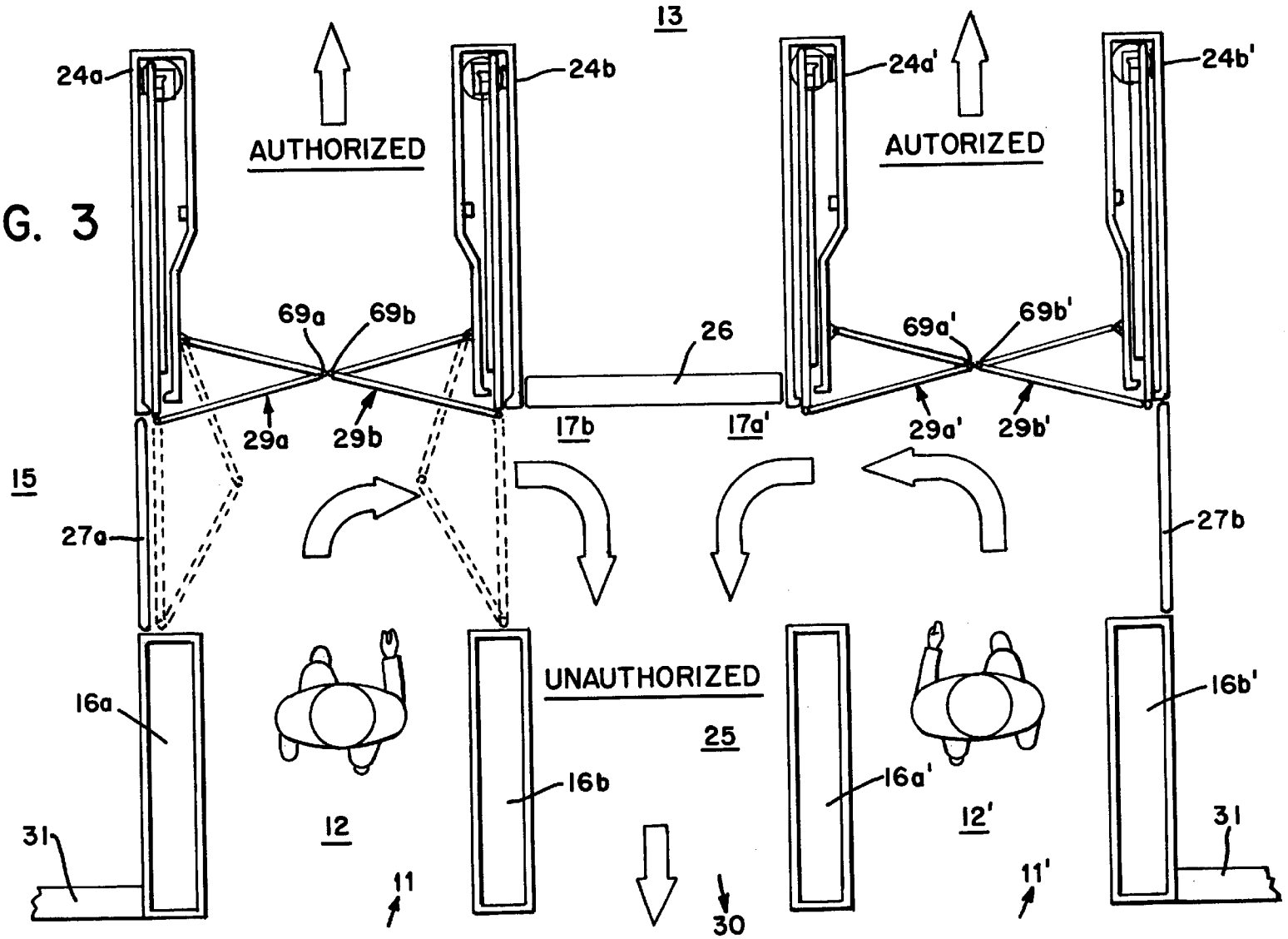
FIG. 3 is a schematic top view diagram of a door system according to the invention having two entrances and one exit for unauthorized persons.

Referring now to FIG. 3, another door access system is shown having two entrances and a single passageway for unauthorized individuals to exit. Thus, a second barrier wall 31 blocking entrance to a secure area 13 is shown having positioned in an opening thereof in spaced relation left entrance modules 16*a* and 16*a*' and right entrance modules 16*b* and 16*b*'. These units placed side by side form first aisles 12 and 12' and second aisle 25. Individuals are shown entering at first entrances 11 and 11' and the door system is shown having doors 29*a* and 29*b* and doors 29*a*' and 29*b*' in their closed positions preventing access to secure first area 13. Left door containing control modules 24*a* and 24*a*' and right door containing control modules 24*b* and 24*b*' are shown positioned to form the continuation of aisles 12 and 12'. A left doorway barrier 27*a* is shown positioned to prevent access to third area 15 and the unauthorized person in aisle 12 must exit through right doorway 17*b* and leave through second aisle 25 out first exit 30. Second aisle barrier 26 is shown positioned between right door containing control module 24*b* and left door containing control module wall 24*a*' to prevent unauthorized access to first area 13. An unauthorized person entering at first entrance 11' will proceed down first aisle 12' but be prevented access to first area 13 by closed doors 29*a*' and 29*b*'. The person must exit the portal system through left doorway 17*a*' into second aisle 25 and exit through first exit 30. Right doorway barrier 27*b*' is shown positioned between the ends of right entrance module 16*b*' and right door containing module 24*b*' preventing access out of the door system to other than the desired exit for unauthorized persons.

It can be seen from FIG. 3 that the flow of individuals is orderly and unauthorized individuals are automatically rerouted from the aisles through which authorized access to a secure area may be achieved. In the event the doors are closed as shown in the figure, the person would automatically reroute to an exit aisle and not backup other individuals entering the system. It will be appreciated that in some cases doors 29*a* and 29*b* will be opened while doors 29*a*' and 29*b*' will be closed. In this event, a person entering first entrance 11 and proceeding down aisle 12 will be able to pass to secure first area 13. If the next person entering first entrance 11 is unauthorized, doors 29*a* and 29*b* will be closed and the person will be automatically rerouted to second aisle 25 and out first exit 30.

With regard to FIG. 4, a skeleton drawing of left door containing control module 24*a* is shown. The left door control module 24*a* is made from an assembly of vertical structural members 52*a* and horizontal structure members 53*a* to form the module 24*a* structure. These modules and the entrance modules are generally rectangular in shape and may be any height depending on the security situation. Motor 32*a* is shown mounted therein and a left drive pulley 47*a* attached thereto. A left drive belt return pulley 46*a* is secured in the module and used with left drive belt drive pulley 47*a* by left drive belt 33*a* stretched therebetween. When motor 32*a* is activated the left drive belt 33*a* will move in a linear direction along the longitudinal axis of the module as shown by the arrows. Door panel 23*a* is connected to left door carriage 50*a*. The carriage is fixedly connected to left door belt bracket 51*a* which is also attached to left drive belt 33*a*. Left linear bearings 49*a* and 49*a*' connected to left door carriage 50*a* rides on left linear bearing rail 48*a* when the door panel 23*a* is moved. The left door control module 24*a* is shown having hinged connections left first hinge 18*a* and left third hinge 22*a* which hinges as well as hinge 20*a* are all preferably continuous hinges running the height of the hinged connection. As discussed hereinabove, the door panels are hinged at these points and a door would be in an opened or closed position depending on whether left door third panel 23*a* is in an extended or retracted position relative to left door control module 24*a*.

As can be seen in FIG. 4, left door third panel 23*a* is shown slightly extended from the left door control module 24*a*. For the door to be in an open position left door third panel 23*a* would be in a fully extended position by motor 32*a* being activated and left drive belt 33*a* being moved. Conversely, when the doors are desired to be in the closed position, the left door third panel 23*a* would be retracted into left door control module 24*a* by activation of motor 32*a* in the reverse direction.

Door sensors 44*a* and 44*a*' are positioned at the base of left door control module 24*a* and permanent magnet 45*a* is shown attached to an end of left moveable door third panel 23*a*. These sensors acting together with the magnet determine if the door is fully opened or closed. A left door position indicator 68*a* sensor (motor motion sensor) is shown positioned on top of motor 32*a*. In general, a rotor with permanent magnet poles is attached to the motor shaft. As the motor runs, the rotor and sensor 68*a* generate pulses to the computer 35. This sensor then determines the position of the door by counting pulses and is used to control the motor speed to close the door rapidly initially from the open position and slowly as the door approaches the closed position and to open the door rapidly initially from the closed position and slowly as the door approaches the open position. For clarity, the CPU unit 35, left motor control 34*a* and left multiplexer 36*a* shown in FIG. 2 are not shown in FIG. 4.

As shown in FIG. 4, the sliding door panel 23*a* has a carriage 50*a* with two sliding bearings 49*a* and 49*a*' and a single linear bearing rail 48*a* which supports the weight of the door assembly. The panel is driven by a single belt 33*a* attached to the sliding panel 23*a* by the drive belt mount 51*a*. The belt 33*a* is stretched between two pulleys, the drive pulley 47*a* and the return pulley 46*a* and a drive shaft (not shown) joins the belt drive pulley 47*a* to the motor 32*a*. The electric motor is preferably a DC motor having variable and reverse speed capability and is controlled by a left motor controller 34*a* (not shown). Other suitable door movement modules may also suitably be employed with the proviso that the door system provide automatic access out of the system to an unsecured area if the person is unauthorized.

Figure 5A:
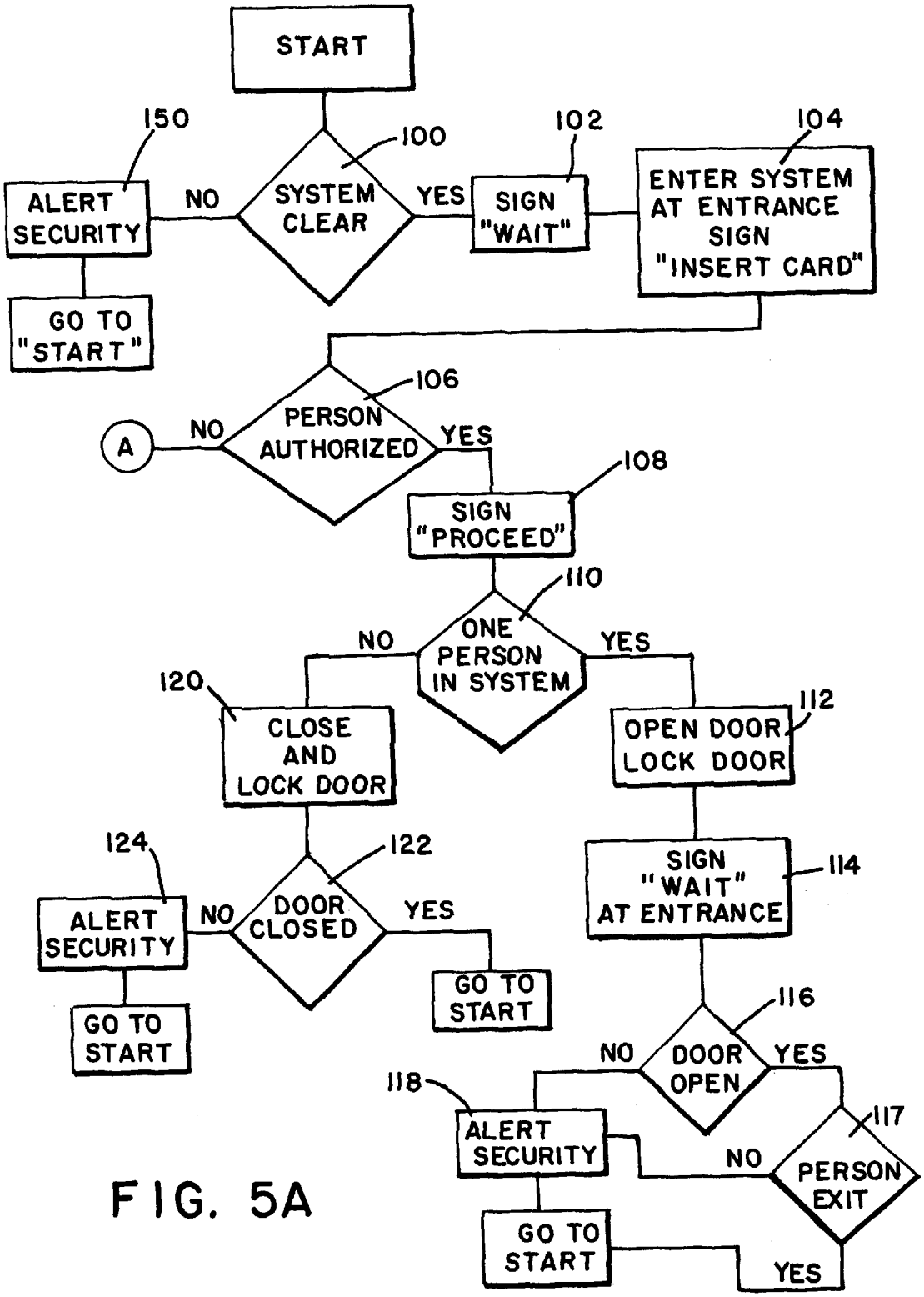
FIGS. 5A and 5B illustrate a block diagram showing a control system used with the portal system and apparatus of the invention.
Figure 5B:
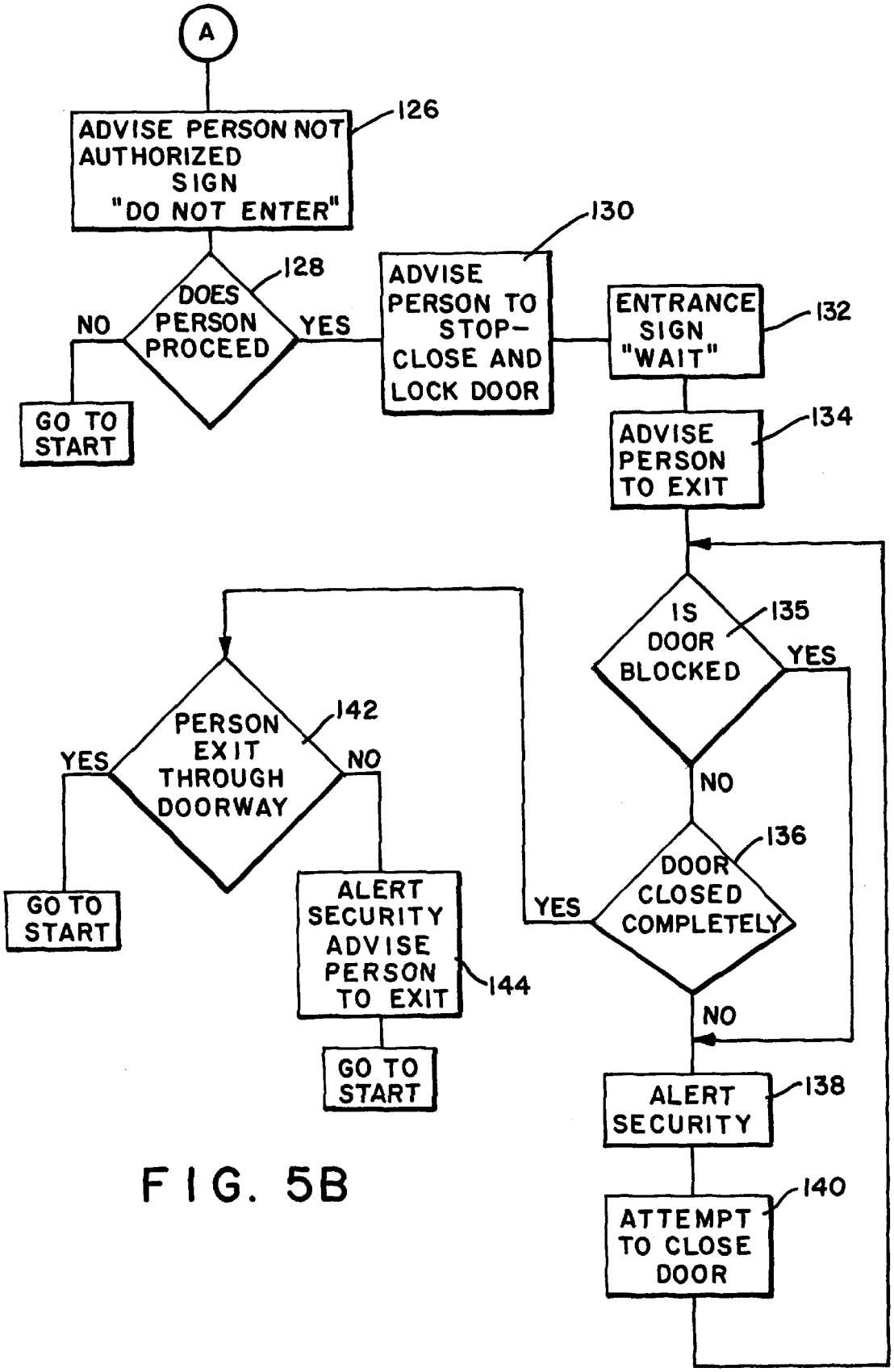

Referring now to FIGS. 5A and 5B, a typical logic flow for use with the computer software to control the system used with the rapid access door system of the invention is described. The system is first checked in step 100 to determine if there is anyone in the system or if there is any other problem with the system and an alert message is provided in step 150 if the system is not clear. If in step 100, the system is clear the person is instructed in step 102 by a visual sign "WAIT" or other indicator positioned at the entrance. The person enters the system at the entrance in step 104 and instructed to "INSERT CARD" and it is determined in step 106 whether the person is authorized by identification card, finger print, paying a fare, etc. If the person is authorized, the person is advised to "Proceed" by a sign in step 108 and the system then checks in step 110 to determine if only one person is entering or in the system. If only one person is entering or in the system the doors will be opened or remain opened in step 112 and the sign at the entrance sign will indicate "WAIT" in step 114 for the next person wanting to enter the system. The doors will be locked in the open position. The system will then check in step 116 to determine if the door is open. If open, the system checks in step 117 if the person exits the system. If the person exits the system the system returns to step 100 to determine if the system is clear and if clear, the sign at the entrance is changed from "WAIT" to "INSERT CARD" and the above procedure repeated. If the person does not exit the system in step 117 security is alerted in step 118 and after proper action the system is reset and ready for another person entering the system at step 100.

If step 110 determines more than one person is in the system, the door is closed and locked in step 120. If the door is determined to be closed in step 122, the system returns to step 100 and the sign at the entrance indicates "WAIT" followed by "INSERT CARD" for the next person to enter when the system is clear. If step 122 indicates the door is not closed and an alert signal is generated in step 124 and after proper action, the system starts again at step 100. It is preferred that the control system attempt to close the door using sensing door blockage means in step 124 wherein the control system will reverse the motor opening the door slightly and attempt to close the door again. This procedure is repeated until the door is closed.

If the person is not authorized in step 106, the person is advised by a sign in step 126 not to enter (DO NOT ENTER) the system. If the person does not enter the system step 128 resets the system and the system is activated again in step 100 for the next person. If the unauthorized person in step 128 proceeds, advise person to stop and the door is closed and locked in step 130 and the sign at the entrance is changed to "WAIT" in step 132. The unauthorized person entering the system is advised to exit through the doorway in step 134. The door is checked in step 135 to determine if it is being blocked. If the door is blocked, security is alerted in step 138 and the system stops and reverses the motor a few revolutions and again tries to close the door in step 140. This procedure is repeated until the door is determined to be unblocked in step 135. If the door is not blocked in step 135, the position of the door is checked in step 136 and if not closed completely, an alert in step 138 is provided and after a set time the door is attempted to be closed again in step 140. This procedure is repeated until the door is determined to be closed completely in steps 135 and 136.

If the door is closed completely in step 136, it is determined in step 142 whether the person exited through the doorway. If the unauthorized person did not exit through the doorway an alert is sounded in step 144 and the person advised to exit. If the unauthorized person did exit through the doorway in step 142 the system returns to step 100 to ensure that the system is clear and ready for the next person.

It will be appreciated by those skilled in the art that there are a wide variety of different processing procedures that can be employed with the rapid access door system of the invention. For example, if multiple modules are used providingmultiple authorized person passageways and unauthorized person exits, the passage sequence can be changed accordingly to accommodate the additional aisles and the additional entrances and exits.

It will also be appreciated that the rapid access door system may be used in many operational modes depending on the day, the time of day, situation in the secured area or other conditions. For example, the portal system may be closed and locked if a number of entrances need to be temporarily limited, such as on weekends or after normal working hours. The rapid access portal system may operate either normally open or normally closed depending on the situation where the system is employed.

The height of the doors associated with left door control module 24*a* and right door control module 24*b* can be manufactured to any height. This would permit the rapid access door system to fit into the opening of the traditional door or any size door depending on the situation. The doors in the opened and closed configuration may be also varied widely to accommodate wheel chairs, existing door structures or other space limitations. While the doors have been described with regard to the use of two doors with each door blocking access to half the aisle it will be appreciated that only one door may be used to block the entire aisle. This type door would still provide an exit for unauthorized persons to exit the system. Additional doors may also be employed if desired for certain situations. The separate modules may also be of any height depending on the access area to be blocked.

Figure 6:
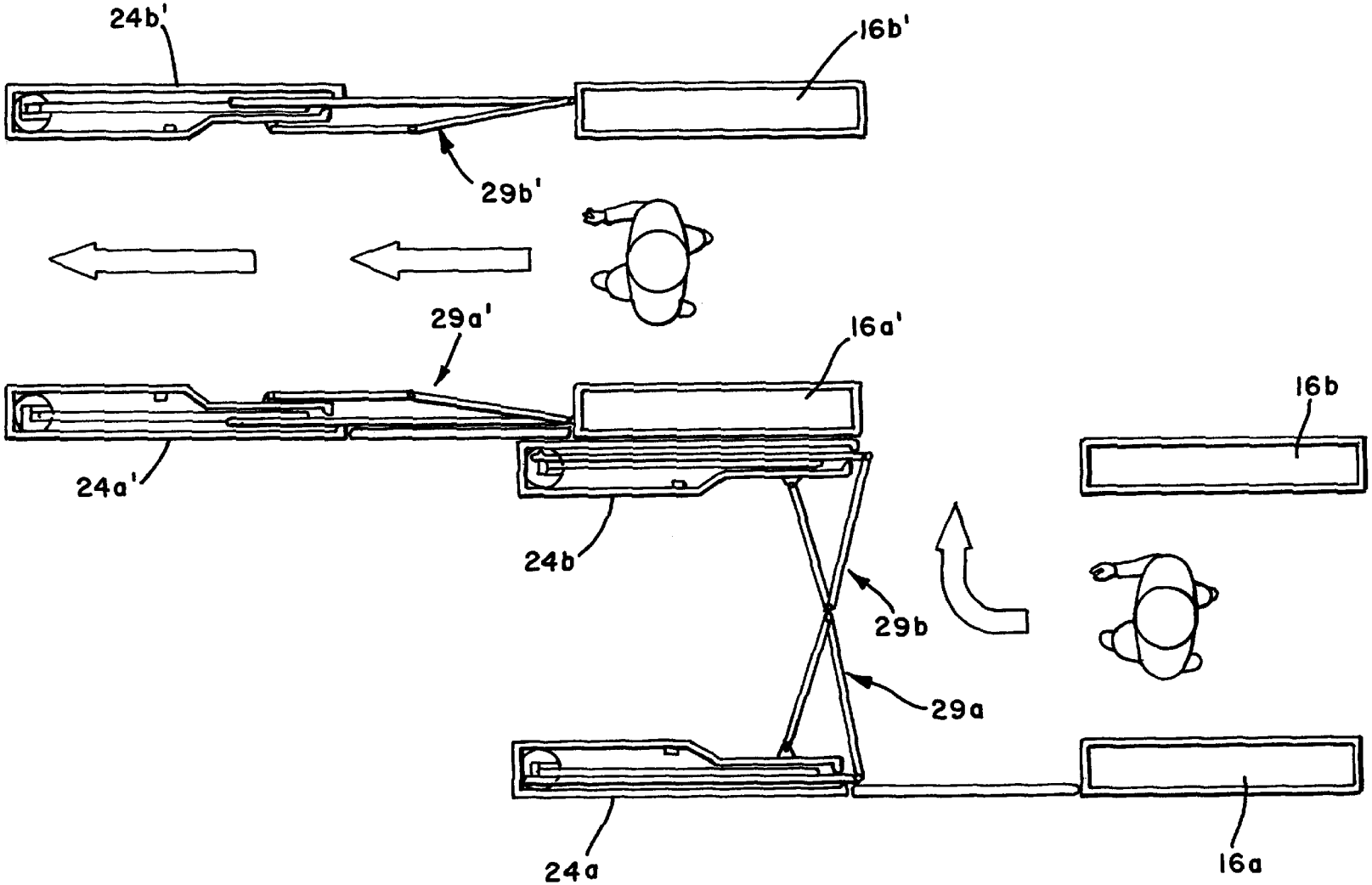
FIG. 6 is a schematic top view diagram of a tandem portal system of the invention.

Referring to FIG. 6, the portal system module units are shown configured and operated in tandem for high traffic situations such as in airports, subways, campuses or office buildings. If an unauthorized person attempts to enter where units are operating in tandem, only that unit closes while the other units remain open. Traffic flow is uninterrupted except for the time it takes for the unauthorized person to exit to the side of the unit. If rejection was a result of not following the correct procedure, the individual, if authorized, may enter the second unit immediately.

Figure 7A:
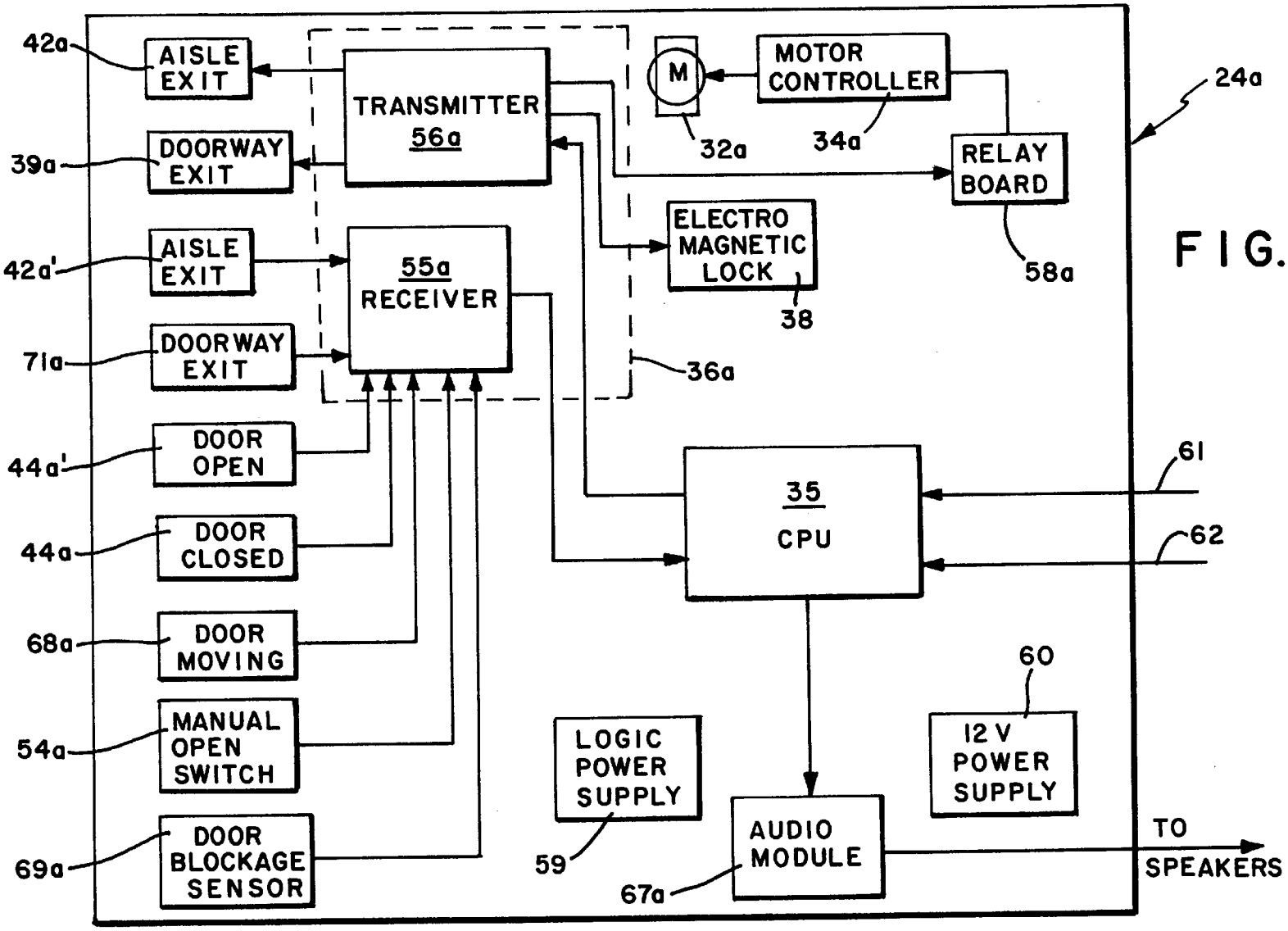
FIGS. 7A and 7B are electrical schematic diagram showing a control system for use with the portal system and apparatus of the invention.
Figure 7B:
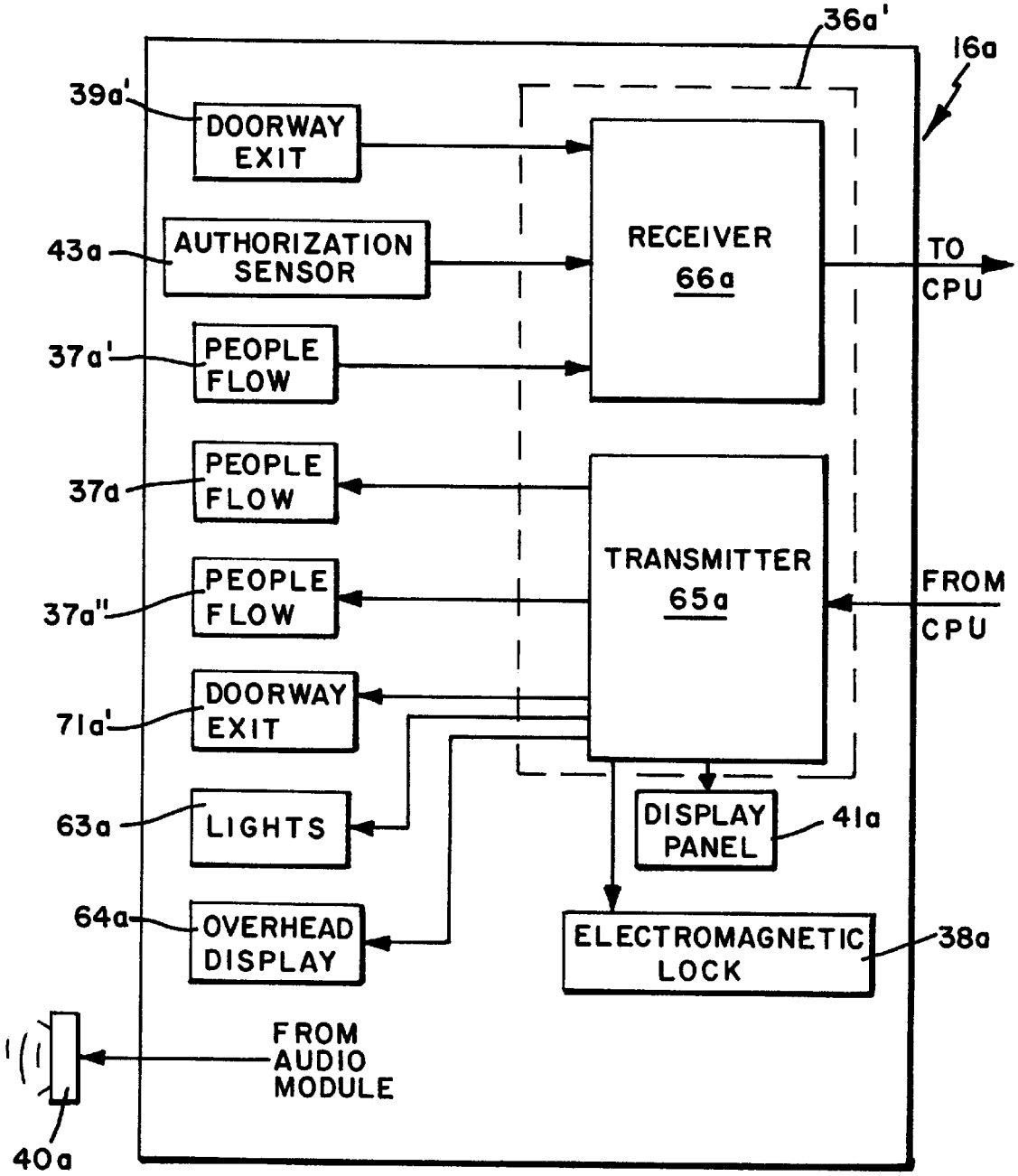

FIGS. 7A and 7B show a schematic diagram of a typical electronic circuit used by the rapid access door system of the invention. Only shown are schematics for left door control module 24*a* and left entrance module 16*a*. The electronic circuits for the opposed modules 24*b* and 16*b* are similar except that module 24*b* does not contain the CPU unit 35, audio module 67*a* and power supplies needed to operate the CPU, sensors and output controls. The multiplexer unit 36*a* contains transmit unit 56*a* and receive unit 55*a*. The multiplexer unit communicates all input and output signals to the CPU 35. Accordingly, as shown for left door control module 24*a* in FIG. 7A, the module contains left exit aisle sensor 42*a*, which would transmit an infra red signal to sensor 42*b* in module 24*b* and doorway exit sensor 39*a* which transmits an infra red signal to doorway exit sensor 39*a*' in module 16*a*. An additional left exit aisle sensor 42*a*' positioned vertically below sensor 42*a* is shown as a receiver and would receive an infra red beam from opposed sensor 42*b*'. Likewise, a doorway exit sensor 71*a* positioned vertically below sensor 39*a* is shown as a receiver and would receive an infra red beam from opposed sensor 71*a*'. The module also contains receiver left door sensors 44*a* and 44*a*', door movement sensor 68*a* and manual open door switch 54*a* which provide input to receiver 55*a*. Door blocking sensing means 69*a* also provides input to CPU 35 through receiver 55*a*. Transmitter 56*a* receives information from CPU unit 35 and transmits the information to left sensors 39*a* and 42*a* which emit infra red energy to sensors 39*a*' and 42*b* respectively. Motor 32*a* is shown controlled by motor controller 34*a* through relay board 58*a* and CPU 35. Unit 59 supplies 5 volt logic power supply and unit 60 supplies 12v sensor and control power. The electronic lock 38*a* is controlled through transmitter 56*a* and CPU 35. Data from and to other system modules to the CPU unit 35 is shown though line 61 and data from and to remote computers through line 62 primarily to load software into the CPU and perform remote diagnostics.

Referring now to left entrance module 16*a* in FIG. 7B, left entrance sensing people flow sensors 37*a* and 37*a*" emit infra red energy to sensors 37*b* and 37*b*", respectively positioned in right entrance module 16*b*. The sensor 37*a*' is a receiver and would receive the infra red energy from sensor 37*b*' and transmit the people flow information to CPU 35. Display panel 41*a*, electromagnetic lock 38*a*, display 64*a*, and lights 63*a* also receive control input from transmit unit 65*a*. Auxiliary system interface sensing authorization means 43*a* determines if a person entering the system is authorized and transmits information about the person to CPU 35 through receiver 66*a* and multiplexer 36*a*'. Doorway exit sensor 39*a*' receives an infra red beam from sensor 39*a*. Doorway exit sensor 71*a*' transmits a beam to sensor 71*a* in module 24*a*. Audio speaker 40*a* receives input directly from audio module 67*a*.

In a preferred embodiment of the invention, people flow sensors, aisle exit sensors and doorway exit sensors are staggered. Thus, with reference to FIG. 7B, people flow sensors 37*a* and 37*a*" are transmitters and opposed sensors 37*b* and 37*b*" are therefore receivers. Sensor 37*a*' is a receiver and therefore opposed sensor 37*b*' is a transmitter. As discussed above, a three by three array of people flow sensors are generally employed in the entrance modules and different combinations of transmitters and receivers can be used. For example, if 37*a*, 37*a*' and 37*a*" are all transmitters, the sensors in the row below in the three by three array would be receivers and the lower row would be transmitters. The above is coordinated with the opposing module so that a transmitted beam is received by an opposed receiver in the opposed module. The above may likewise be employed for doorway exit sensors and aisle exit sensors as shown in FIGS. 7A and 7B wherein vertically spaced sensors in each module may be staggered for transmission and receiving of the infra red beams. Other sensor array configurations could also be employed to achieve desired infra red beam scanning effects.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A rapid access door system comprising:

an entrance having authorization means for authorizing a person to pass therethrough;

an aisle extending from the entrance to a bi-fold door and past the bi-fold door to a secure area;

a doorway situated before the bi-fold door on one side of the aisle for exiting the aisle to an unsecure area;

the bi-fold door which is pivotable on vertical axes and is fixedly secured at one pivot axis to the aisle;

to means for moving the bi-fold door based on the authorization means on a third pivot axis along a line parallel to the aisle; and wherein when the bi-fold door is in a closed first position, the door blocks the aisle to the secure area and the doorway is open to the unsecure area and when the bi-fold door is in an open second position, the aisle is open to the secure area and the door blocks the doorway to the unsecure area.

2. The door system of claim 1 wherein the bi-fold door is moved by motor means.

3. The door system of claim 2 wherein the bi-fold door comprises a first bi-fold door and a second opposed bi-fold door, each door in its closed position blocking about half the aisle and in their open positions the first door blocking the doorway and the second door blocking an opposed doorway.

4. The door system of claim 3 wherein people flow sensors are used to determine the number of persons in the aisle.

5. The door system of claim 4 wherein exit aisle sensors are used to determine if a person passes through the aisle to the secure area.

6. The door system of claim 5 wherein doorway exit sensors are used to determine if a person exits the system through a doorway.

7. The door system of claim 6 wherein hall effect door sensors are used to determine if the doors are in the open and closed positions.

8. The door system of claim 7 wherein door position indicator means are used to determine the position of the door and to control the speed of the motor to open and close the door at different rates depending on the position of the door.

9. The door system of claim 8 wherein door blockage sensors are used to determine if the door is being obstructed and to activate the motor in limited repeated open and close motions to attempt to close the door.

10. A rapid access door system comprising:

a door;

an entrance having authorization means for authorizing a person passing therethrough;

a first aisle extending from the entrance through the door to a first area, the first aisle being formed by, in sequence, a left entrance module and an opposed right entrance module, a left door and an opposed right door each extending in its closed position across about half the width of the first aisle wherein the doors in their open position allow passage from the entrance to the first area with the left door forming a left door wall and the right door forming an opposed right door wall, and, a left door containing module forming a left door module wall and an opposed right door containing module forming a right door module wall;

a left doorway intersecting the first aisle between the downstream end of the left entrance module and the start of the left door containing module; and a right doorway intersecting the first aisle between the downstream end of the right entrance module and the start of the right door containing module;

the left door containing module comprising a left door having an open position which provides communication of the first aisle with the first area and having a closed position which blocks about half the width of the first aisle and provides communication of the first aisle with the left doorway;

the right door containing module comprising a right door having an open position which provides communication of the first aisle with the first area and having a closed position which blocks about half the width of the first aisle and provides communication of the first aisle with the right doorway;

the left door having a first left vertically pivotal member hinged at both ends by a first left hinge fixedly secured to the left door containing module and a second left hinge, a second left vertically pivotal member hinged at one end by the second left hinge and at the other end by a third left hinge and a third left vertically pivotal member hinged at one end by the third left hinge and at the other end being attached to a left carriage which third left member moves linearly with the left carriage in and out of the module along the longitudinal axis of the left door containing module when the door is opened and closed and has an extended and a retracted position;

the right door having a first right vertically pivotal member hinged at both ends by a first right hinge fixedly secured to the right door containing module and a second right hinge, a second right vertically pivotal member hinged at one end by the second right hinge and at the other end by a third right hinge and a third right vertically pivotal member hinged at one end by the third right hinge and at the other end being attached to a right carriage which third right member moves linearly with the right carriage in and out of the module along the longitudinal axis of the right door containing module when the door is opened and closed and has an extended and a retracted position;

wherein when the left door and right door are in their closed positions by the left carriage and right carriage being retracted respectively in the left door containing module and right door containing module, communication of the first aisle with the first area is blocked and both the left doorway and right doorway are open; and wherein when the left door and right door are both in their open position by each carriage being extended respectively toward the left entrance module and right entrance module, communication of the first aisle with the first area is open and both the left doorway and right doorway are blocked.

11. The door system of claim 10 where a plurality of modules are employed in spaced relationship to form a plurality of entrances and at least one exit aisle.

12. The door system of claim 10 wherein sensors are employed in the modules to determine authorization information about persons entering the system and the information is used by a control system to control opening and closing of the doors.

13. The door system of claim 12 wherein the left entrance module and right entrance module contain people flow sensors to determine the number of persons in the aisle formed by the two modules.

14. The door system of claim 13 wherein the left door containing module and right door containing module contain exit aisle sensors to determine if a person passes through the aisle formed by the two modules and enters the first area.

15. The door system of claim 14 wherein the left entrance module and left door containing module and right entrance module and right door containing module contain doorway exit sensors to determine if a person exits the system through the first doorway or second doorway respectively.

16. The door system of claim 15 wherein the left door containing module and right door containing module contain hall effect door sensors to determine if the doors are in the open or closed positions.

17. The door system of claim 16 wherein door position indicator sensing means is employed by the system to determine the position of the door and control the speed of a motor to open and close the door at different rates depending on the position of the door.

18. The door system of claim 17 wherein the system employs sensing door blockage means to determine if the door is being obstructed from closing and to control the motor to attempt to close the door in repeated open and close motions.

19. A rapid access door apparatus comprising:

an entrance having authorization means for authorizing a person to pass therethrough;

an aisle extending from the entrance to a bi-fold door and past the bi-fold door to a secure area;

a doorway situated before the bi-fold door on one side of the aisle for exiting the aisle to an unsecure area;

the bi-fold door which is pivotable on vertical axes and is fixedly secured at one pivot axis to the aisle;

means for moving the bi-fold door based on the authorization means on a third pivot axis along a line parallel to the aisle; and wherein when the bi-fold door is in a closed first position, the door blocks the aisle to the secure area and the doorway is open to the unsecure area and when the door is in an open second position, the aisle is open to the secure area and the door blocks the doorway to the unsecure area;

sensing means for determining authorization information about persons entering the apparatus and the position of the door;

moving means for opening and closing the bi-fold door;

control means for opening and closing the bi-fold door in response to the sensing means.

20. The rapid access door apparatus of claim 19 wherein the door comprises a first bi-fold door and a second opposed bi-fold door, each door in its closed position blocking about half the aisle and in their open positions the first door blocking the doorway and the second door blocking an opposed doorway.

21. The rapid access door apparatus of claim 20 wherein people flow sensors are used to determine the number of persons in the aisle.

22. The rapid access door apparatus of claim 21 wherein exit aisle sensors are used to determine if a person passes through the aisle and enters the secure area.

23. The rapid access door apparatus of claim 22 wherein doorway exit sensors are used to determine if a person exits the apparatus through a doorway.

24. The rapid access door apparatus of claim 23 wherein hall effect door sensors are used to determine if the doors are in the open and closed positions.

25. The rapid access door apparatus of claim 24 wherein door position indicator sensing means are used to determine the position of the door and to control the speed of the motor to open and close the door at different rates depending on the position of the door.

26. The rapid access door apparatus of claim 25 wherein door blockage sensing means are used to determine if the door is being obstructed from closing and to activate the motor to attempt to close the door.

27. A rapid access door apparatus is provided comprising:

a door;

an entrance having authorization means for authorizing a person passing therethrough;

a first aisle extending from the entrance through the door to a first area, the first aisle being formed by, in sequence, a left entrance module and an opposed right entrance module, a left door and an opposed right door each extending in its closed position across about half the width of the first aisle wherein the doors in their open position allow passage from the entrance to the first area with the left door forming a left door wall and the right door forming an opposed right door wall, and, a left door containing module forming a left door module wall and an opposed right door containing module forming a right door module wall;

a left doorway intersecting the first aisle between the downstream end of the left entrance module and the start of the left door containing module; and a right doorway intersecting the first aisle between the downstream end of the right entrance module and the start of the right door containing module;

the left door containing module comprising a left door having an open position which provides communication of the first aisle with the first area and having a closed position which blocks about half the width of the first aisle and provides communication of the first aisle with the left doorway;

the right door containing module comprising a right door having an open position which provides communication of the first aisle with the first area and having a closed position which blocks about half the width of the first aisle and provides communication of the first aisle with the right doorway;

the left door having a first left vertically pivotal member hinged at both ends by a first left hinge fixedly secured to the left door containing module and a second left hinge, a second left vertically pivotal member hinged at one end by the second left hinge and at the other end by a third left hinge and a third left vertically pivotal member hinged at one end by the third left hinge and at the other end being attached to a left carriage which third left member moves linearly with the left carriage in and out of the module along the longitudinal axis of the left door containing module when the door is opened and closed and has an extended and a retracted position;

the right door having a first right vertically pivotal member hinged at both ends by a first right hinge fixedly secured to the right door containing module and a second right hinge, a second right vertically pivotal member hinged at one end by the second right hinge and at the other end by a third right hinge and a third right vertically pivotal member hinged at one end by the third right hinge and at the other end being attached to a right carriage which third right member moves linearly with the right carriage in and out of the module along the longitudinal axis of the right door containing module when the door is opened and closed and has an extended and a retracted position;

wherein when the left door and right door are in their closed positions by the left carriage and right carriage being retracted in the left door containing module and right door containing module respectively, communication of the first aisle with the first area is blocked and both the left doorway and right doorway are open; and wherein when the left door and right door are both in their open position by each carriage being extended toward the left entrance module and right entrance module respectively, communication of the first aisle with the first area is open and both the left doorway and right doorway are blocked;

sensing means for determining authorization information about persons entering the apparatus;

control means for opening and closing the doors in response to the sensing means.

28. The apparatus of claim 27 where a plurality of modules are employed in spaced relationship to form a plurality of entrances and at least one exit aisle.

29. The door system of claim 27 wherein sensors are employed in the modules to determine authorization information about persons entering the system and the information is used by the control system to control opening and closing of the doors.

30. The door system of claim 29 wherein the left entrance module and right entrance module contain people flow sensors to determine the number of persons in the aisle formed by the two modules.

31. The door system of claim 30 wherein the left door containing module and right door containing module contain exit aisle sensors to determine if a person passes through the aisle formed by the two modules and enters the first area.

32. The door system of claim 31 wherein the left entrance module and left door containing module and right entrance module and right door containing module contain doorway exit sensors to determine if a person exits the system through the first doorway or second doorway respectively.

33. The door system of claim 32 wherein the left door containing module and right door containing module contain hall effect door sensors to determine if the doors are in the open and closed positions.

34. The door system of claim 33 wherein door position indicator sensing means in employed by the system to determine the position of the door and to control the speed of a motor to open and close the door at different rates depending on the position of the door.

35. The door system of claim 34 wherein the system employs sensing door blockage means to determine if the door is being obstructed from closing and to activate the motor to attempt to close the door.

* * * * *